United States Patent [19]

Chun et al.

[11] Patent Number: 5,048,816

[45] Date of Patent: Sep. 17, 1991

[54] WORKPIECE REGISTRATION SYSTEM AND METHOD FOR DETERMINING THE POSITION OF A SHEET

[75] Inventors: Victor L. Chun, Holland; Gerard J. Schorn, Southampton, both of Pa.

[73] Assignee: Murata Wiedemann, Inc., King of Prussia, Pa.

[21] Appl. No.: 549,937

[22] Filed: Jul. 9, 1990

[51] Int. Cl.[5] ..... B65H 9/18

[52] U.S. Cl. ..... 271/227; 271/236; 271/255; 83/368; 72/31

[58] Field of Search ..... 271/226-228, 271/236, 245, 255; 83/368; 72/31

[56] References Cited

U.S. PATENT DOCUMENTS

| | | | |
|---|---|---|---|
| 3,244,418 | 4/1966 | Henderson | 271/227 |
| 4,095,512 | 6/1978 | Stark | 83/368 |
| 4,303,152 | 12/1981 | Widmaier | 271/147 |
| 4,533,239 | 8/1985 | Back | 271/236 |
| 4,674,738 | 6/1987 | DuBois | 271/227 |
| 4,708,759 | 11/1987 | Porat | 271/227 |
| 4,922,773 | 5/1990 | Ito | 271/236 |

FOREIGN PATENT DOCUMENTS

| | | | |
|---|---|---|---|
| 43148 | 4/1981 | Japan | 271/227 |

*Primary Examiner*—Robert P. Olszewski
*Assistant Examiner*—Steve Reiss
*Attorney, Agent, or Firm*—John R. Benefiel

[57] ABSTRACT

A system is disclosed for registering a sheet in punch press or other apparatus having a control system carrying out a programmed position of the sheet during punching operations, in which a movable locator plate is urged into an advanced position along an axis of movement so as to be displaced when the sheet is moved a fixed distance along one axis. A distance transducer generates a continuously varying electrical signal corresponding to the displacement of the locator plate from its advanced position, which signal is transmitted to the control system to modify the part program in accordance with the actual location of the sheet.

12 Claims, 2 Drawing Sheets

WORKPIECE REGISTRATION SYSTEM AND METHOD FOR DETERMINING THE POSITION OF A SHEET

This invention concerns work handling apparatus in punch presses and similar machines and more particularly sheet work handling apparatus having automated control systems for moving the workpiece to predetermined locations in the press, cooperating with automated sheet handling apparatus for loading workpieces.

Such apparatus typically is provided with a table and supporting carriage which is driven under the control of the machine control system along a first or "Y" axis.

A gripper mechanism is also provided, supported on a cross slide which is driven along a second or "X" axis orthogonal to the Y axis to enable controlled positioning of a sheet in the X-Y plane for carrying out operations.

With automated loading, the sheet is carried into the gripper mechanism by the loader, with the grippers subsequently activated to grip the sheet.

The edge location of the sheet must be precisely set initially since the loader cannot locate the edge with sufficient precision to insure that the sheet is in a known position before operations begin. In the past, sheet aligning devices were operated to drive the edge of the sheet against a fixed stop at a precisely determined location. However, where a wide variation in sheet thickness was encountered, the driving force had to be set to be sufficient to reliably locate relatively heavy sheets, and this same force tended to buckle or even crush very thin sheets.

In U.S. Pat. No. 4,213,733 issued on July 22, 1980 for "Automatic Side Gauge for Machine Tool Workpiece Control and Method" there is described an arrangement for avoiding this difficulty. In that arrangement, an external switch is provided which controls the operation of the X-axis gripper drive as the sheet is being driven in the X-axis so that the drive is discontinued immediately after the edge contacts the switch. The switch also provides an indication to the machine controls of the location of the sheet edge at a particular time. Since such machines also include an encoder for feeding cross slide position signals to the machine controls, this event enables the edge location to be determined for purposes of moving the sheet to desired positions in the X-Y plane.

A disadvantage to this approach is that the control of the cross slide drive is made dependent on an external device, i.e., the switch. This reduces the reliability of the system and necessitates various failsafe measures such as a second switch and mechanical ramp as described in the aforementioned patents.

SUMMARY OF THE INVENTION

The present invention comprises a sheet edge registration system including an arrangement of a locator plate mounted to be movable along the X-axis. The locator plate is lightly spring biased to a predetermined advanced position lying in the path of the sheet edge along the X-axis, but spaced therefrom a distance sufficient to insure that the loader will position the sheet edge away therefrom. The locator plate is drivingly connected to the input rod of a distance transducer, producing a continuous variable electrical output signal corresponding to the distance the locator plate is displaced from its advanced position.

The machine controls are programmed to drive the cross slide a fixed distance along the X-axis in a direction so as to bring the edge into engagement with the locator plate and drive the same a distance less than the range of displacement of the transducer. The transducer output signal is transmitted to the machine control, which adapts the programmed motion of the sheet to the actual position of the sheet edge as determined by the transducer signal.

An alternative fixed stop configuration of the locator plate mounting is also provided.

The system does not require external control devices interacting with the machine main controls to provide a highly reliable operation.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
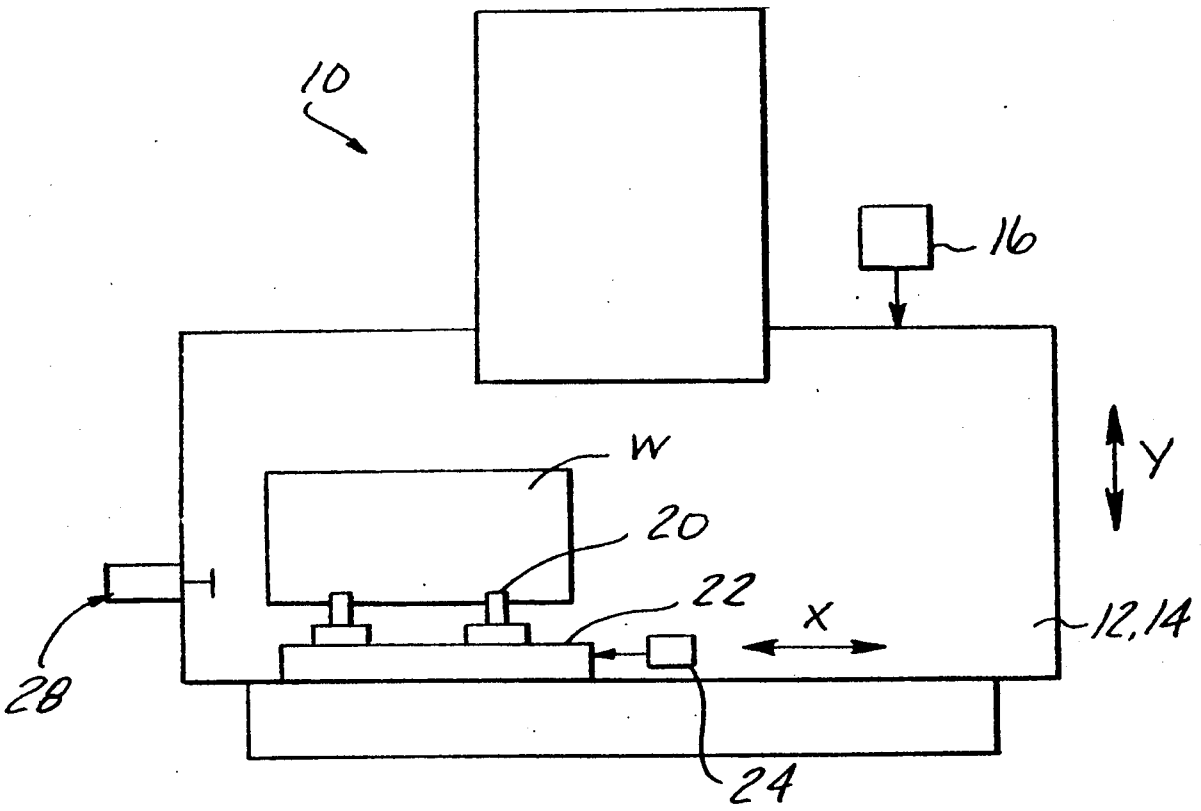
FIG. 1 is a diagrammatic plan view of a punch press and related work handling apparatus having the registration system installed thereon.
Figure 2:
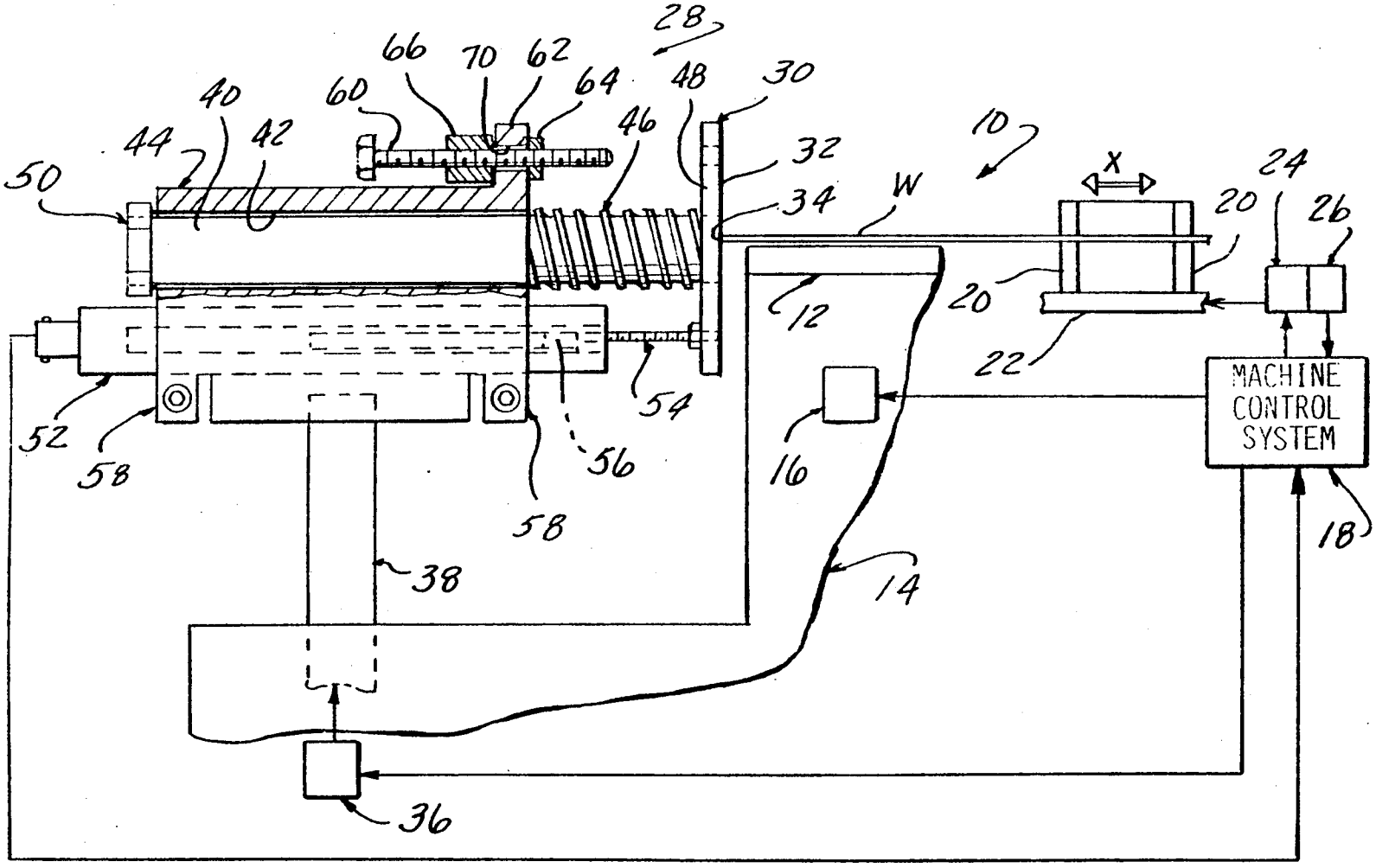
FIG. 2 is a partially sectional view of a locator plate and distance transducer mounting on a punch press carriage with a diagrammatic representation of other related structure and machine main controls.

Referring to FIGS. 1 and 2, portions of a punch press machine 10 and related work handling apparatus are represented, including a table top 12 mounted on a Y-axis carriage 14. The carriage 14 is adapted to be traversed in a Y-axis direction, normal to the drawing view, by means of an actuator 16 under the guidance of signals from the main machine controls 18. A sheet workpiece W after being loaded is held by grippers 20 carried on a cross slide 22 mounted to the carriage 14. Cross slide 22 is adapted to be reciprocated in the X-axis indicated by means of an actuator 24 under the guidance of signals from the machine control 18. An encoder 26 provides signals allowing the machine control 18 to have precise information relating to the position of the cross slide 22 at all times. Such arrangement of carriage, gripper cross slide, actuators, encoder, and machine control are well known in the art, and further details are not here provided.

The arrangement 28 according to the present invention includes a locator plate 30 having an end face 32 positionable along the X-axis so as to be engaged by the edge 34 of the workpiece W upon driving of the cross slide 22 in that direction.

An actuator 36 having a non-rotatable output rod 38 is mounted on the carriage 14, and allows retraction of the entire arrangement 28 except when carrying out a sheet registration operation as will be described, so as to eliminate any interference with other press operations at other times.

The locator plate 30 is mounted for free movement along the X-axis by means of a slide shaft 40 attached thereto and slidably fit within a bore 42 in a housing 44. A lightweight spring 46 encircles the shaft 40 and is compressed between the back side 48 of the locator plate 30 and the forward face of the housing 44 to lightly urge the locator plate 30 to a precisely defined, advanced position, in which a stop piece 50 abuts the rear face of the housing 44. The spring force should be sufficient to reliably move the locator plate 30 to the advanced position but light enough so that the thinnest workpiece to be encountered will not be damaged or buckled by that force.

A distance transducer 52 is mounted beneath the locator plate 30 and slide shaft 40, having a threaded input rod 54 also attached to the locator plate 30. The distance transducer 52 may comprise an LVDT device, in which the position of the input rod 54 controls the position of a core 56 within a transducer housing 58, the housing 58 secured as with a integral with the housing 44. The transducer housing 58 contains transformer windings and the core position varies the transformer coupling in a manner such that a continuously varying electrical output signal corresponding to the position of the input rod along the X-axis is generated.

Such transducers are well known in the art for providing precision displacement information.

An optional fixed stop may be provided by a bolt 60 threaded into a flange 62 and secured with lock nut 64 by advancing the bolt 60 against a spacer 66 and into a threaded bore 70 so that the locator plate 30 may be fixed for manual registration operations.

The position should be at a "zero" reference position half way intermediate the range of motion of the distance transducer.

The machine control 18 is suitably programmed for a sheet registration operation to drive the cross slide 22 a fixed predetermined limited distance towards the locator plate 30. This distance is selected to insure some displacement of the locator plate 30 in the most extreme away position of the sheet W in the grippers 20 within the tolerance of the loader. Such distance is typically on the order of one inch. Also, the range of motion of the transducer 52 must be sufficient to allow unimpeded movement of the locator plate 30 when the sheet W is initially in the most proximate location in the grippers 20 within the tolerance of the loader, again a distance on the order of one inch.

The actuator 24 thus drives the cross slide 22 to drive the edge 34 of the sheet W against the face 32 of locator plate 30, displacing the same an indeterminant distance depending on the actual initial position of the sheet W in the grippers 20.

The output of the transducer 52 is transmitted to the machine control, where it is combined with stored reference signals in the machine control, wherein the reference datum of the X-axis is shifted, therefore effectively adjusting the required travel distance in the part program to reflect the actual X-axis location of the sheet relative to the punch point.

While the system has been described as applied to a punch press, it will be understood by one skilled in the art that the sheet registration system is applicable to other applications where precise location of a sheet is required, such as a cutting shear.

We claim:

1. A system for providing sheet registration in a sheet handling apparatus having a control system for precisely moving a sheet in a plane defined by X and Y axes by means of grippers included in said apparatus adapted to hold a sheet loaded therein, a cross slide having said grippers mounted thereo; and a carriage mounting said cross slide moved along said respective X and Y axes under the guidance of said control system to carry out a part program, said system including an arrangement comprised of a locator plate positionable along said X-axis so as to have a face engaged by the edge of a sheet upon continued movement of said cross slide in one direction;

slider means mounting said locator plate for free movement away from an advanced position;

means lightly urging said locator plate towards said advanced position;

stop means precisely locating said locator plate in said advanced position;

distance transducer means generating a continuously variable electrical signal corresponding to the position of said locator plate away from said advanced position;

means transmitting said displacement transducer signals to said control system, whereby upon driving said sheet a fixed distance so as to displace said locator plate from said advanced position, said part program can take into account the exact position of said sheet in said grippers.

2. The system for providing sheet registration according to claim 1 wherein said distance transducer comprises an LVDT having an input rod fixed to said locator plate.

3. The system for providing sheet registration according to claim 1 further including fixed stop means for alternatively fixing said locator plate in an intermediate location within the range of movement of said distance transducer.

4. The system for providing sheet registration according to claim wherein said control system moves said cross slide a predetermined fixed distance on the order of one inch during sheet registration.

5. The system for providing sheet registration according to claim 4 wherein said distance transducer has a range of motion on the order of one inch.

6. The system for providing sheet registration according to claim 1 wherein said arrangement is mounted on said carriage by means allowing selective registration thereof.

7. A method of registering a sheet loaded into initial positions in a gripper means of a sheet handling apparatus at indeterminate locations within a limited range of positions along one axis in said gripper means, said apparatus having a control system and actuators for positioning the sheet in a plane defined by X and Y axes, including the steps of:

positioning a movable locator structure along the path of movement of said sheet in at least one of said axes at a precisely located advanced position;

moving said sheet by operation of one of said actuators a fixed distance sufficient to displace at least slightly said locator structure for all positions of said sheet through said range of loaded positions of said sheet in said gripper means;

generating continuously varying electrical signals corresponding to the displacement of said locator structure from said advanced position; and transmitting said signal to said control system and modifying said part program to reflect the atual sheet location as determined by the magnitude of said signal.

8. The method according to claim 7 wherien said sheet is moved a fixed distance on the order ofone inch.

9. The method according to claim 7 wherein said locator plate is lightly urged to said advanced position at a force level below that causing bending of said sheet.

10. The method according to claim 7 further including the step of retracting said locator structure whenever said registration method is not being conducted.

11. The method according to claim 7 including the step of alternatively fixing said locator structure in a position away from said advanced position.

12. The method according to claim 7 wherein the machine control maintains a position reference datum of said sheet along said at least one axis for processing control, and wherein said modifying step, said reference datum is shifted to reflect the actual sheet position.

* * * * *